US005727645A

United States Patent [19]

Woodling

[11] Patent Number: 5,727,645

[45] Date of Patent: Mar. 17, 1998

[54] AERIAL LIFT INCLUDING A DETACHABLE END-HUNG BASKET

[75] Inventor: Roger M. Woodling, Omaha, Nebr.

[73] Assignee: Glazer Enterprises, Inc., Omaha, Nebr.

[21] Appl. No.: 642,692

[22] Filed: May 3, 1996

[51] Int. Cl.[6] ..... B66F 11/04

[52] U.S. Cl. ..... 182/2.1; 182/2.11

[58] Field of Search ..... 182/2, 63, 2.1, 182/2.11

[56] References Cited

U.S. PATENT DOCUMENTS

| | | | |
|---|---|---|---|
| 3,295,633 | 1/1967 | Milner | 182/2 |
| 4,518,059 | 5/1985 | Frey-Wigger | 182/2 |
| 4,606,469 | 8/1986 | Van Deijk | 182/2 |
| 4,754,840 | 7/1988 | MacDonald | 182/2 |
| 5,271,707 | 12/1993 | Derksen et al. | 182/2 |

FOREIGN PATENT DOCUMENTS

| | | | |
|---|---|---|---|
| 2626865 | 8/1989 | France | 182/2 |
| 20763 | 1/1990 | Japan | 182/63 |
| 1572440 | 7/1980 | United Kingdom | 182/2 |

*Primary Examiner*—Alvin C. Chin-Shue

*Attorney, Agent, or Firm*—Zarley,McKee,Thomte, Voorhees & Sease; Dennis L. Thomte

[57] ABSTRACT

An aerial lift comprising a self-propelled vehicle such as a truck or the like having a rotatable pedestal mounted thereon. An elongated telescopic boom has one end pivotally secured, about a horizontal axis, to the pedestal. A first support is pivotally secured, about a horizontal axis, to the upper end of the telescopic boom and has a second support pivotally secured thereto, about a vertical axis, to the outer end thereof. The second support has a first connector at its outer end which is adapted to be removably connected to a second connector element provided on a work station. The connector elements cooperate to mount the work station on the upper end of the telescopic boom and which may be disconnected to remove the work station from the telescopic boom.

8 Claims, 6 Drawing Sheets

AERIAL LIFT INCLUDING A DETACHABLE END-HUNG BASKET

BACKGROUND OF THE INVENTION

1. Field of the Invention

This invention relates to an aerial lift having an end-hung basket which is removably secured to the upper end of the top boom section of the telescoping boom assembly of the aerial lift. The upper end of the top boom section carries a cable sheave thereon to enable a winch cable to be extended therearound, and downwardly therefrom, when the basket is mounted on the boom assembly. Further, the mounting means for the basket carries a cable sheave thereon which is adapted to receive the winch cable extending therearound and downwardly therefrom when the basket is removed from the boom assembly, so that the downwardly extending winch cable may be closely positioned adjacent a vertical wall or the like.

2. Description of the Related Art

Many types of aerial lifts including a telescoping boom assembly have been previously provided. Further, many of those aerial lifts included a personnel carrier bucket, basket or work platform mounted on the upper end of the top boom section of the boom assembly. However, it is not believed that any of the prior art aerial lifts had an end-hung basket mounted thereon which could be quickly and easily mounted on the boom assembly and which can be quickly and easily disconnected therefrom. Further, it is not believed that the prior art aerial lifts had a cable sheave mounted on the basket mounting means which enabled an associated winch cable to be extended therearound so as to extend downwardly therefrom to enable the winch cable to be closely positioned adjacent a vertical wall or building when the basket is removed from the boom structure.

SUMMARY OF THE INVENTION

An aerial lift is provided which is mounted on a self-propelled vehicle such as a truck or the like having rearward and forward ends. A rotatable pedestal is provided on the vehicle and has an elongated, telescopic boom assembly pivotally mounted thereon, about a horizontal axis. A first supporting structure is pivotally secured, about a horizontal axis, to the outer end of the top boom section of the boom assembly. A second supporting structure is pivotally secured, about a vertical axis, to the outer end of the first supporting structure and has a first connector element at its outer end. An end-hung basket is provided for supporting at least one person therein and which has a second connector element at its inner end which may be selectively connected to the first connector element on the first supporting structure to mount the basket on the upper end of the top boom section of the boom assembly. A first cable sheave is provided on the upper end of the top boom section to enable a winch cable to be extended therearound and downwardly therefrom, when the basket is mounted on the boom assembly. A second cable sheave is mounted on the first supporting structure which is adapted to have the winch cable extended therearound so as to extend downwardly therefrom, when the basket has been removed from the top boom section, to enable the winch cable to be closed positioned adjacent a vertical wall or the like.

It is therefore a principal object of the invention to provide an improved aerial lift including a detachable end-hung basket mounted thereon.

Yet another object of the invention is to provide an aerial lift which may serve as a crane when the basket is removed therefrom.

Yet another object of the invention is to provide an aerial lift including a detachable work station such as a basket, platform, etc., which is quickly and easily mounted on the boom assembly and which is quickly and easily disconnected from the boom assembly.

Still another object of the invention is to provide an apparatus of the type described which is safe to use.

These and other objects will be apparent to those skilled in the art.

DESCRIPTION OF THE PREFERRED EMBODIMENT

Figure 1:
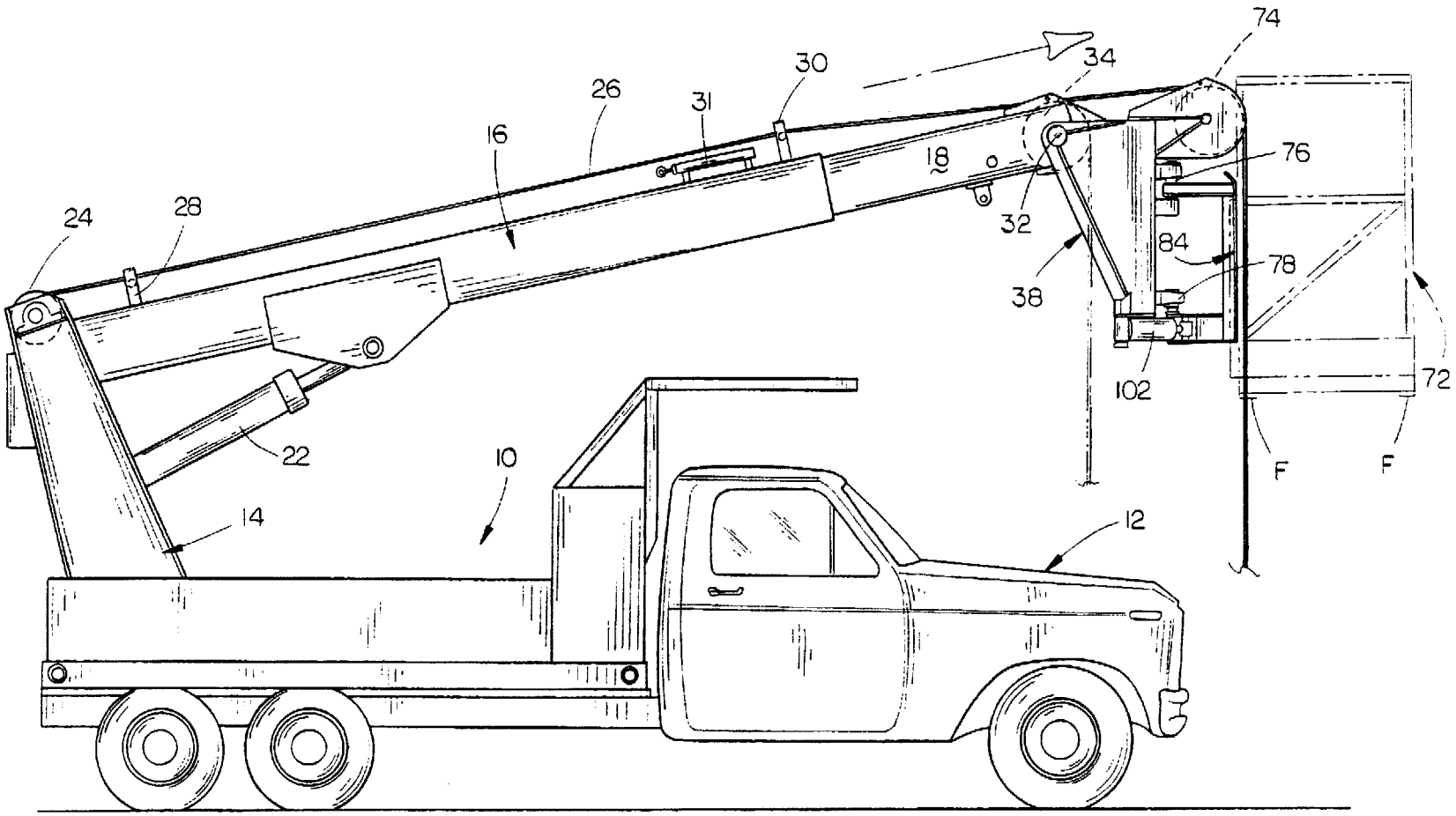
FIG. 1 is a side view of the aerial lift of this invention.
Figure 2:
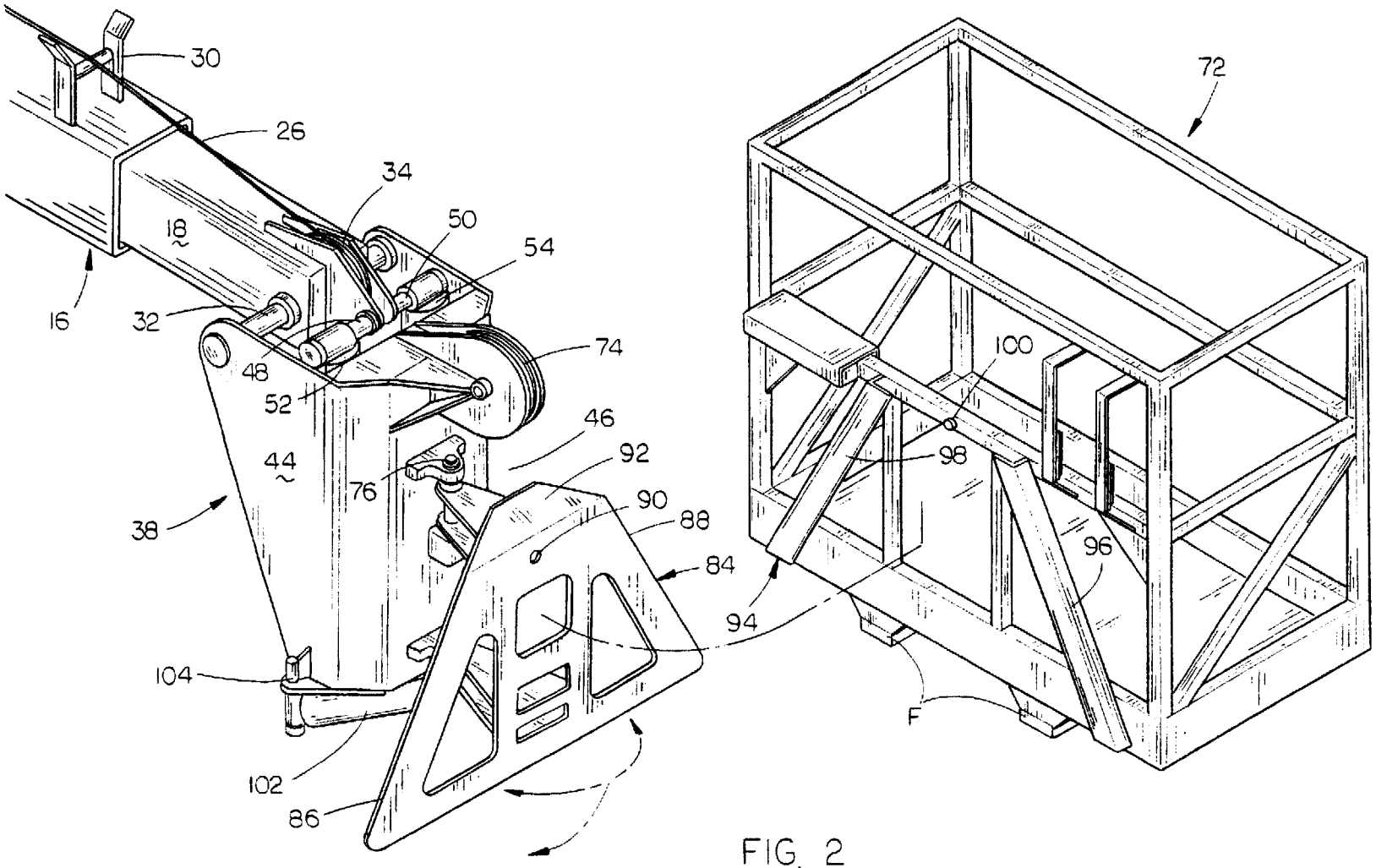
FIG. 2 is an exploded perspective view of the detachable end-hung basket and its associated mounting structure.
Figure 3:
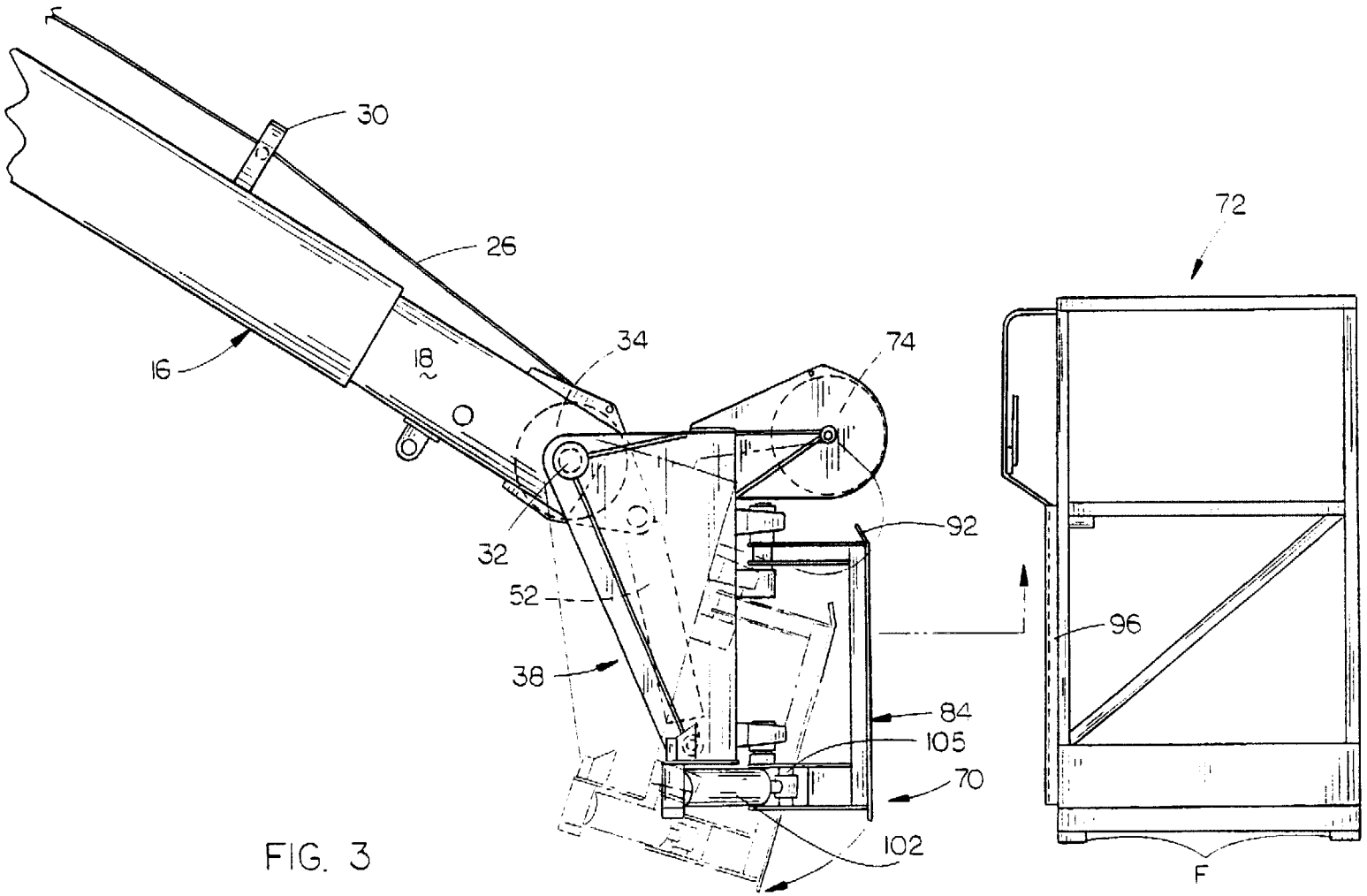
FIG. 3 is a side elevational view of the structure of FIG. 2 and which illustrates the basket having been removed from its supporting structure.
Figure 4:
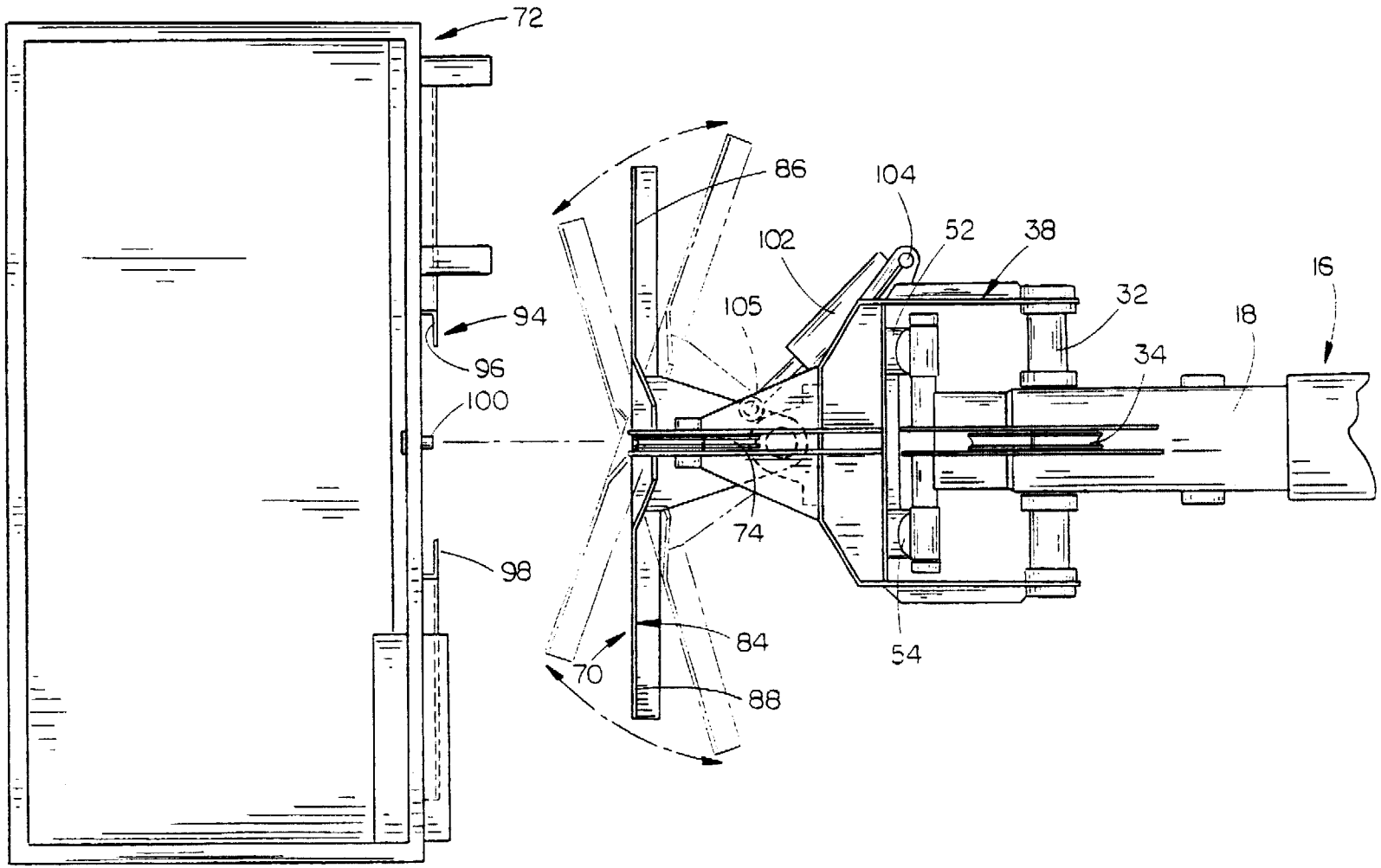
FIG. 4 is a top elevational view of the structure of FIG. 3.

The aerial lift of this invention is referred to generally by the reference numeral 10 which is mounted on a self-propelled vehicle 12 such as a truck or the like. Aerial lift 10 includes a conventional horizontally rotatable pedestal 14 having a conventional telescoping boom structure or assembly 16 pivotally secured, about a horizontal axis, to the upper end of pedestal 14. For purposes of description, boom assembly 16 will be described as including a top boom section 18 including an upper or outer end 20. Boom assembly 16 is extended and retracted in conventional fashion by means of a hydraulic cylinder (not shown) positioned within the boom assembly 16 in conventional fashion. Further, boom assembly 16 is conventionally pivoted with respect to pedestal 14 by hydraulic cylinder 22.

A conventional cable winch 24 is mounted on the upper end of pedestal 14, or the inner end of boom structure 16 if so desired, and has a winch cable 26 extending therefrom along the length of the boom assembly 16. As seen in FIG. 1, a pair of cable stand-offs or supports 28 and 30 are mounted on boom assembly 16 for supporting the cable 26 thereon at times. Additionally, the free end of cable 26 may be secured to the spring-loaded retainer assembly 31 when the cable 26 is not being used. Horizontally disposed shaft 32 extends through the upper end 20 of top boom section 18 and has a cable sheave 34 rotatably mounted thereon which is adapted to receive the cable 26 extending therearound, as will be described in more detail hereinafter.

The numeral 38 refers to a first supporting structure having an upper end 40, a lower end 42 and opposite sides 44 and 46. The upper inner ends of supporting structure 38 are pivotally or rotatably mounted on the outer ends of shaft 32. It is also possible to rigidly secure the upper inner ends of supporting structure 38 to shaft 32 if shaft 32 is rotatably mounted on top boom section 18. Shaft 48 is secured to and extends outwardly from one side of the upper end of top boom section 18 towards side 44 of supporting structure 38. Shaft 50 is secured to and extends outwardly from the other side of the upper end of boom section 18 towards side 46 of supporting structure 38. The base ends of hydraulic cylinders 52 and 54 are pivotally mounted on shafts 48 and 50, respectively. The cylinder rod 56 of cylinder 52 is operatively pivotally secured, about a horizontal axis, to the lower end of supporting structure 38 in conventional fashion. Similarly, the lower end of the cylinder rod 58 (not shown) is pivotally secured, about a horizontal axis, to the lower end of supporting structure 38. Extension of the cylinder rods 56 and 58 from cylinders 52 and 54 causes the lower end of supporting structure 38 to pivotally move away from the top boom section 18. Conversely, retraction of the cylinder rods 56 and 58 into cylinders 52 and 54 causes the lower end of supporting structure 38 to move towards the top boom section 18. As will be explained hereinafter, cylinders 52 and 54 permit the supporting structure 38 to be correctly positioned with respect to the second supporting structure 70 when the personnel basket 72 is disconnected from the upper end of boom section 18 and to permit the personnel basket 72 to be properly leveled with respect to the ground, when the basket 72 is mounted on the boom assembly 16. Cable sheave 74 is rotatably mounted on the upper outer end of first supporting structure 38 and is adapted to have the winch cable 26 extended therearound, as will be described in greater detail hereinafter.

Figure 5:
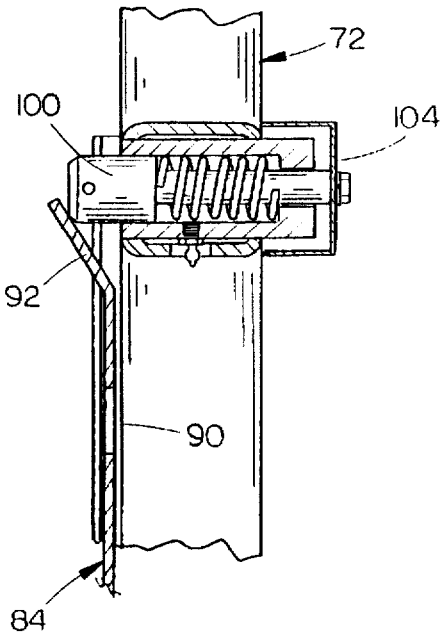
FIG. 5 is a sectional view illustrating the manner in which the locking pin is retracted during the mounting of the basket.
Figure 6:
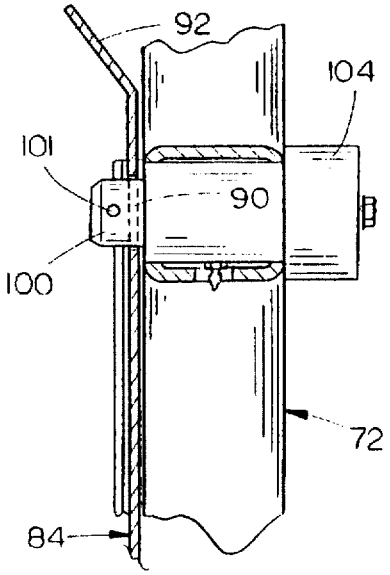
FIG. 6 is a view similar to FIG. 5 except that the locking pin has moved to its locking position.
Figure 7:
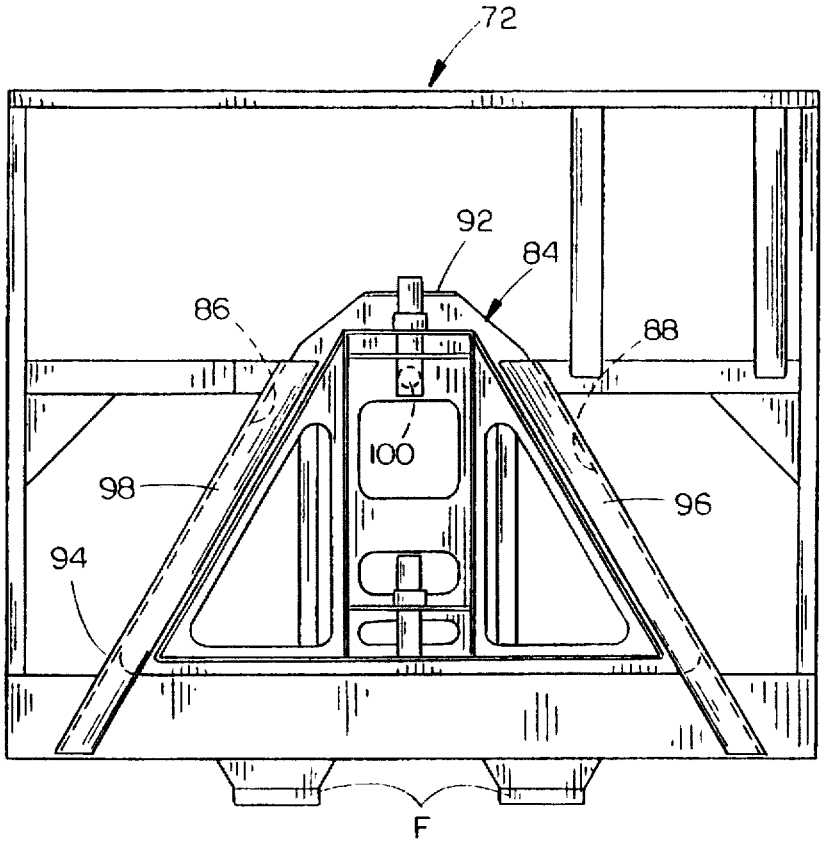
FIG. 7 is a rear view of the bucket after it has been mounted on its supporting structure.
Figure 8:
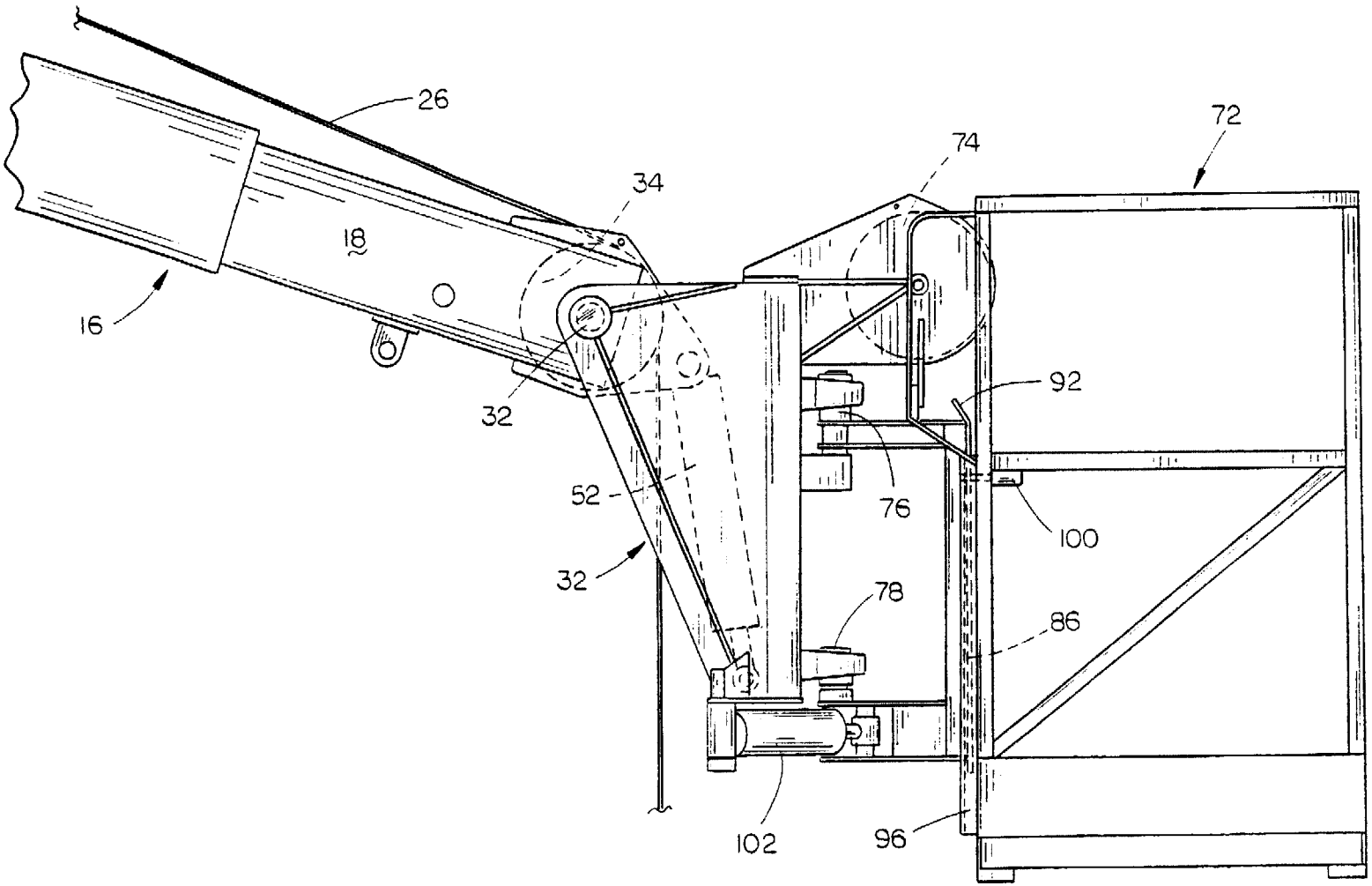
FIG. 8 is a side elevational view similar to FIG. 3 except that the bucket has been mounted on the boom assembly.

Second supporting structure 70 is pivotally secured, about a vertical axis, to first supporting structure 70 at 76 and 78. Supporting structure 70 is provided with a triangular-shaped connector 84 at its outer end which includes diverging connector elements 86 and 88. The upper end of connector 84 is provided with an opening 90 and a guide plate 92 positioned thereabove. Basket 72 is provided with a connector 94 at its inner end which includes diverging connector elements 96 and 98 adapted to receive connector elements 86 and 88 therein, respectively, to permit the selective removable mounting of basket 72 on supporting structure 70. When connector elements 96 and 98 completely receive the connector elements 86 and 88, respectively, spring-loaded locking pin 100, positioned on basket 72, is automatically inserted into opening 90, and locked therein, to prevent the inadvertent disconnection of basket 72 from supporting structure 70. During the connection operation of the basket 72 to the supporting structure 70, guide plate 92 moves upwardly with respect to basket 72 thereby causing the locking pin 100 to be retracted until pin 100 is aligned with opening 90 at which time the spring associated with locking pin 100 causes pin 100 to automatically extend into opening 90, as seen in FIGS. 5 and 6.

Hydraulic cylinder 102 has its base end pivotally secured to supporting structure 38 at 104 and has its rod end pivotally connected to supporting structure 70 at 105 to enable supporting structure 70, and basket 72, to be selectively pivotally moved, about a vertical axis, with respect to supporting structure 38 and boom section 18.

Assuming that the basket 72 has been removed from the boom assembly 16, the aerial lift of this invention may be used as a crane with either the winch cable 26 extending around the sheave 34 and downwardly therefrom or around the sheave 74 and downwardly therefrom. In those situations where it is desirable to closely position the downwardly extending portion of the winch cable 26 adjacent a vertical wall or building, the winch cable 26 is extended around the sheave 74 and will extend downwardly therefrom outwardly of the second supporting structure 84, when the basket 72 has been removed from the supporting structure 70.

When it is desired to mount the basket 72 on the aerial lift, the boom assembly is maneuvered so that the connector 84 is positioned adjacent the inner end of the basket 72 between and below the connector elements 96 and 98. The connector 84 may be easily maneuvered with respect to the connector elements 96 and 98 on basket 72 through the use of the hydraulic cylinder within boom assembly 16, hydraulic cylinder 22, hydraulic cylinders 52 and 54, as well as hydraulic cylinder 102. Once the connector 84 is properly positioned with respect to the connector elements 96 and 98, hydraulic cylinder 22 is extended to cause connector 84 to be raised with respect to basket 72 which will cause the connector elements 86 and 88 to be received by the receivers or connector elements 96 and 98, respectively. The locking pin 100 is normally in its extended locking position, as illustrated in FIG. 5. As the connector 84 is raised with respect to the basket 72, guide plate 92 engages the inner end of locking pin 100 and causes the same to be retracted and to pass along the outer surface of the connector 84 as the connector 84 is raised with respect to the basket 72. The connector 84 is raised with respect to the basket 72 until the inner end of the locking pin 100 registers with the opening 90 in connector 84 at which time the locking pin 100 moves to the position illustrated in FIG. 6. If desired, a retaining key (not shown) may be inserted in the opening 101 in the outer end of locking pin 100 to positively prevent the disengagement of the pin 100 from the opening 90.

When the basket 72 is mounted on the supporting structure 70, the basket may be raised by means of the hydraulic cylinder 22 and may be pivoted to the right or left by means of the hydraulic cylinder 102. The basket 72 may be leveled with respect to the ground by means of the hydraulic cylinders 52 and 54. As stated, when the basket 72 is mounted on the supporting structure 70, the winch cable 26 may be extended over the sheave 34 and downwardly therefrom to enable objects to be raised and lowered thereby.

When it is desired to remove the basket 72 from the aerial lift, the basket 72 is placed on the ground so that the supporting legs or feet F are in ground engagement. Not only do the supporting feet F support the basket 72 on the ground, but they also provide sufficient vertical clearance to enable the connector 84 to be lowered with respect to the connector elements 96 and 98. When it is desired to remove the basket 72 from the boom assembly and the basket 72 is supported upon the ground, the retaining key is first removed from the opening 101 in the locking pin 100. The locking pin 100 is then moved to its unlocked position by grasping the tube 104, which is connected to the locking pin 100, as seen in FIG. 5, and pulling the same forwardly until locking pin 100 disengages from the opening 90. At that time, the connector 84 is lowered with respect to the connector elements 96 and 98 to cause the disengagement of the connector 84 from the connector elements 96 and 98. The boom assembly 16 is then slightly retracted to separate connector 84 from the basket 72.

Thus it can be seen that a novel aerial lift apparatus has been described which includes a basket or work station which is mounted on the boom structure in an end-hung fashion and which may be easily and quickly mounted thereon or removed therefrom. Further, it can be seen that a novel aerial lift apparatus has been provided which includes a first cable sheave located at the upper end of the top boom section to enable a winch cable to be extended therearound at times and which includes a second cable sheave mounted thereon adapted to alternatively receive the winch cable therearound when the basket is removed from the boom assembly.

Thus it can be seen that a novel invention has been provided which accomplishes at least all of its stated objectives.

I claim:

1. In an aerial lift, comprising:

a self-propelled vehicle;

a rotatable pedestal on said vehicle;

an elongated, telescopic boom assembly having upper and lower ends and having its lower end pivotally secured, about a horizontal axis, to said pedestal;

means for pivotally moving said boom assembly with respect to said pedestal;

a first supporting structure having inner and outer ends and having its inner end pivotally secured, about a horizontal axis, to the upper end of said boom assembly;

means for pivotally moving said first supporting structure relative to said boom assembly;

a second supporting structure having inner and outer ends and having its inner end pivotally secured, about a vertical axis, to the outer end of said first supporting structure;

said second supporting structure having a first connector at its outer end;

a work station for supporting at least one person therein;

said work station having inner and outer ends;

said work station having a second connector provided thereon at its inner end which may be removably selectively connected to said first connector to mount said work station on said boom assembly in an end-hung fashion;

said first connector comprising a triangular-shaped plate means having upwardly converging first and second connector elements at the opposite sides thereof;

said second connector comprising a pair of spaced-apart, upwardly converging third and fourth connector elements which are adapted to removably receive said first and second connector elements, respectively.

2. The aerial lift of claim I wherein said pedestal has an upper end and wherein a cable winch having a cable wound thereon is positioned at the upper end of said pedestal, a first cable sheave rotatably mounted about a horizontal axis, on the upper end of said boom assembly whereby said cable may be passed therearound so as to extend downwardly from said upper end of said boom assembly inwardly of said first supporting structure, said first supporting structure having upper and lower ends, a second cable sheave rotatably mounted, about a horizontal axis, on the upper end of said first supporting structure whereby said cable may be alternatively passed therearound so as to extend downwardly therefrom outwardly of said first connector element when said work station is removed from said boom assembly.

3. The aerial lift of claim 1 including locking means for preventing the inadvertent disconnection of said second connector from said first connector, said locking means comprising a locking pin movably mounted on the inner end of said work station between said third and fourth connector elements which is selectively received by an opening formed in said triangular-shaped plate means between said first and second connector elements.

4. The aerial lift of claim 3 wherein said locking pin is normally in an extended locking position and wherein said second supporting structure includes means for engagement with said locking pin to move said locking pin to an unlocked position during the connection of said second connector to said first connector.

5. In combination with an aerial lift including a self-propelled vehicle having a rotatable pedestal thereon which has an elongated, telescopic boom assembly, with upper and lower ends, said boom assembly having its lower end pivotally secured, about a horizontal axis, to the upper end of said pedestal, and means for pivotally moving said boom assembly with respect to said pedestal, comprising:

a first supporting structure having inner and outer ends and having its inner end pivotally secured, about a horizontal axis, to the upper end of said boom assembly;

means for pivotally moving said first supporting structure relative to said boom assembly;

a second supporting structure having inner and outer ends and having its inner end pivotally secured, about a vertical axis, to the outer end of said first supporting structure;

said second supporting structure having a first connector at its outer end;

a work station for supporting at least one person therein;

said work station having inner and outer ends;

said work station having a second connector provided thereon at its inner end which may be removably selectively connected to said first connector to mount said work station on said boom assembly in an end-hung fashion;

said first connector comprising a triangular-shaped plate means having upwardly converging first and second connector elements at the opposite sides thereof;

said second connector comprising a pair of spaced-apart, upwardly converging third and fourth connector elements which are adapted to removably receive said first and second connector elements, respectively.

6. The combination of claim 5 wherein said pedestal has an upper end and wherein a cable winch having a cable wound thereon is positioned at the upper end of said pedestal, a first cable sheave rotatably mounted about a horizontal axis, on the upper end of said boom assembly whereby said cable may be passed therearound so as to extend downwardly from said upper end of said boom assembly inwardly of said first supporting structure, said first supporting structure having upper and lower ends, a second cable sheave rotatably mounted, about a horizontal axis, on the upper end of said first supporting structure whereby said cable may be alternatively passed therearound so as to extend downwardly therefrom outwardly of said first connector element when said work station is removed from said boom assembly.

7. The combination of claim 5 including locking means for preventing the inadvertent disconnection of said second connector from said first connector, said locking means comprising a locking pin movably mounted on the inner end of said work station between said third and fourth connector elements which is selectively received by an opening formed in said triangular-shaped plate means between said first and second connector elements.

8. The combination of claim 7 wherein said locking pin is normally in an extended locking position and wherein said second supporting structure includes means for engagement with said locking pin to move said locking pin to an unlocked position during the connection of said second connector to said first connector.

* * * * *